US006062883A

United States Patent [19]

Schreiber et al.

[11] Patent Number: 6,062,883

[45] Date of Patent: May 16, 2000

[54] ELECTRICAL PLUG EJECTOR WITH MODULE

[76] Inventors: James W. Schreiber, 2031 W. Nantucket Ct., Littleton, Colo. 80120; Robert J. Evans, 1583 W. Saltsage Dr., Phoenix, Ariz. 85054

[21] Appl. No.: 09/133,015

[22] Filed: Aug. 12, 1998

Related U.S. Application Data

[60] Provisional application No. 60/055,591, Aug. 12, 1997.

[51] Int. Cl.[7] ..... H01R 13/62

[52] U.S. Cl. ..... 439/159; 439/923

[58] Field of Search ..... 439/158, 159, 439/152, 155, 923, 622

[56] References Cited

U.S. PATENT DOCUMENTS 2,688,734 9/1954 Welling ..... 439/159

3,475,715 10/1969 Venaleck ..... 439/152

4,820,176 4/1989 Niikura ..... 439/152

5,704,811 1/1998 Hsu ..... 439/622

*Primary Examiner*—Khiem Nguyen

*Assistant Examiner*—Javaid Nasri

[57] ABSTRACT

A plug ejector comprises a solenoid incorporated into an electrical plug. An adapter plugs into a wall socket and presents an adapter socket for receiving the plug. Upon activation by a remote switch, the solenoid projects its armature to react against the adapter socket to eject the plug. The plug may be incorporated into an appliance cord, or an extension cord. The plug may incorporate a GFI protector, or a vibration sensor. Another embodiment utilizes an appliance's on-off switch to operate the ejector.

4 Claims, 15 Drawing Sheets

ELECTRICAL PLUG EJECTOR WITH MODULE

RELATED APPLICATION

This application claims priority of U.S. Provisional patent application No. 60/055591, filed Aug. 12, 1997.

FIELD OF THE INVENTION

This invention relates generally to electrical plugs and, more particularly, to an ejector for ejecting an electrical plug from a wall socket.

BACKGROUND OF THE INVENTION

Many domestic and industrial appliances, such as sweepers and floor polishers, are used over large areas and have very long power cords which enable their use down long hallways to a location remote from where the power cord is plugged into a wall socket. In order to continue use of such an appliance, the operator must walk a long distance to unplug the cord, then walk back and plug the cord into a sequence of widely spaced wall outlets to complete the sweeping of polishing task. This consumes an excessive amount of unproductive time by the appliance operator.

There is a need for an appliance which does not require continual manual plugging and unplugging of the power cord. There have been many attempts to provide devices for enabling the remote unplugging of an appliance power cord by manipulating the power cord. Many of these have been patented, as evidenced by U.S. Pat. Nos. 2,394,618; 2,490,580; 2,456,548; 2,696,594; 2,986,719; 3,737,835; 3,936,123; 4,114,969; and 4,045,106. It is noteworthy that, although this problem was recognized at least as early as 1944, there has been no successful commercialized solution.

Thus, there is a need for a device which enables an appliance operator to unplug the appliance cord from a remote electrical socket by ejecting the plug from the socket without moving from the appliance.

There is also a need for such a device which is an integral part of the plug mounted on the end of the appliance power cord. There is also a need for such a device which is a self-contained unit which can be used with existing appliances having conventional plugs.

It would also be advantageous to incorporate vibration-sensing or tilt-sensing actuators for causing ejection of the plug from the socket to disconnect appliances during earthquakes or other building-damaging events to reduce the possibility of an appliance-caused fire.

Older electrical sockets tend to be corroded, which increases the frictional force with which it retains plug prongs. Also, plugs that have been used many times may be crimped due to many instances of off-axis removal. To accommodate the vast variety of forces needed to remove all plugs from all sockets, the solenoid effecting the ejection must be very strong, and, hence, large and expensive.

Thus, there is a need for a device which is compact and inexpensive, and which will reliably eject a plug from a socket.

There is also a need for a plug ejector which is an integral part of an extension cord that is adaptable to all existing appliances.

There is a further need for a plug ejector which does not require additional wiring, but utilizes an appliance's power supply wiring and switch to activate the plug ejector.

SUMMARY OF THE INVENTION

It is therefore an object of this invention to provide a device which is compact and inexpensive, and which will reliably eject a plug from a socket.

It is another object to provide a device which is an integral part of the plug mounted on the end of the appliance power cord.

It is yet another object to provide a device which is a self-contained unit which can be used with existing appliances having conventional plugs.

It is still another object to provide a device which incorporates vibration-sensing or tilt-sensing actuators for causing ejection of the plug from the socket to disconnect appliances during earthquakes or other building-damaging events to reduce the possibility of an appliance-caused fire.

It is a further object to provide a plug ejector which is compact and inexpensive, and which will reliably eject a plug from a socket.

It is a yet further object to provide a plug ejector which is an integral part of an extension cord that is adaptable to all existing appliances.

It is a still further object to provide a plug ejector which does not require additional wiring, but utilizes an appliance's power supply wiring and switch to activate the plug ejector.

It is an even further object to provide a plug ejector which incorporates ground fault interruption.

In a preferred embodiment, this invention features a plug ejector assembly for ejecting an electrical plug from an electrical supply socket which is an integral part of a power cord plug, comprising an adaptor for insertion into an electrical supply socket and having an adaptor socket, a plug housing, an ejector member mounted in the housing for sliding movement between a retracted position and an extended position, and an electric motor for moving the ejector member from retracted to extended position, whereby the plug prongs are inserted into the adaptor socket, subsequent energization of the electric motor extends the ejector member to impact the socket and eject the prongs from the adaptor socket apertures. plug ejector for ejecting an electrical plug from an electrical supply socket which is an integral part of a power cord plug. Preferably, the electric motor is a solenoid.

The plug may be mounted on the end of an elongated power cord of an electric appliance, which mounts an actuating switch for actuating the electric motor.

The actuating switch may also includes a sensor for sensing vibrations above a predetermined intensity and actuating the actuating switch in response thereto.

The actuating switch may include a sensor for sensing tilting of the plug beyond a predetermined angle relative to the horizontal and actuating the actuating switch in response thereto.

The terminal prongs are connected to the operating terminals of an operating switch of a remote electric appliance by an elongated electric cord, and a separate line connects the electric motor to an actuator on the appliance for operation thereby.

In another embodiment, the plug ejector is a self-contained unit having receptacle slots for receiving prongs of an electric appliance connector and electrically connecting them to the electrical plug terminal prongs. In this embodiment, the actuator includes a sensor which senses rapid sequential on-off operation of the appliance operating switch to energize the solenoid and eject the ejector terminal prongs from the socket apertures.

In another embodiment, the plug ejector is an integral part of an extension cord.

These and further objects and features of this invention will become more readily apparent upon reference to the following detailed description of a preferred embodiment, as illustrated in the accompanying drawings, in which:

DETAILED DESCRIPTION OF PREFERRED EMBODIMENTS

Figure 1:
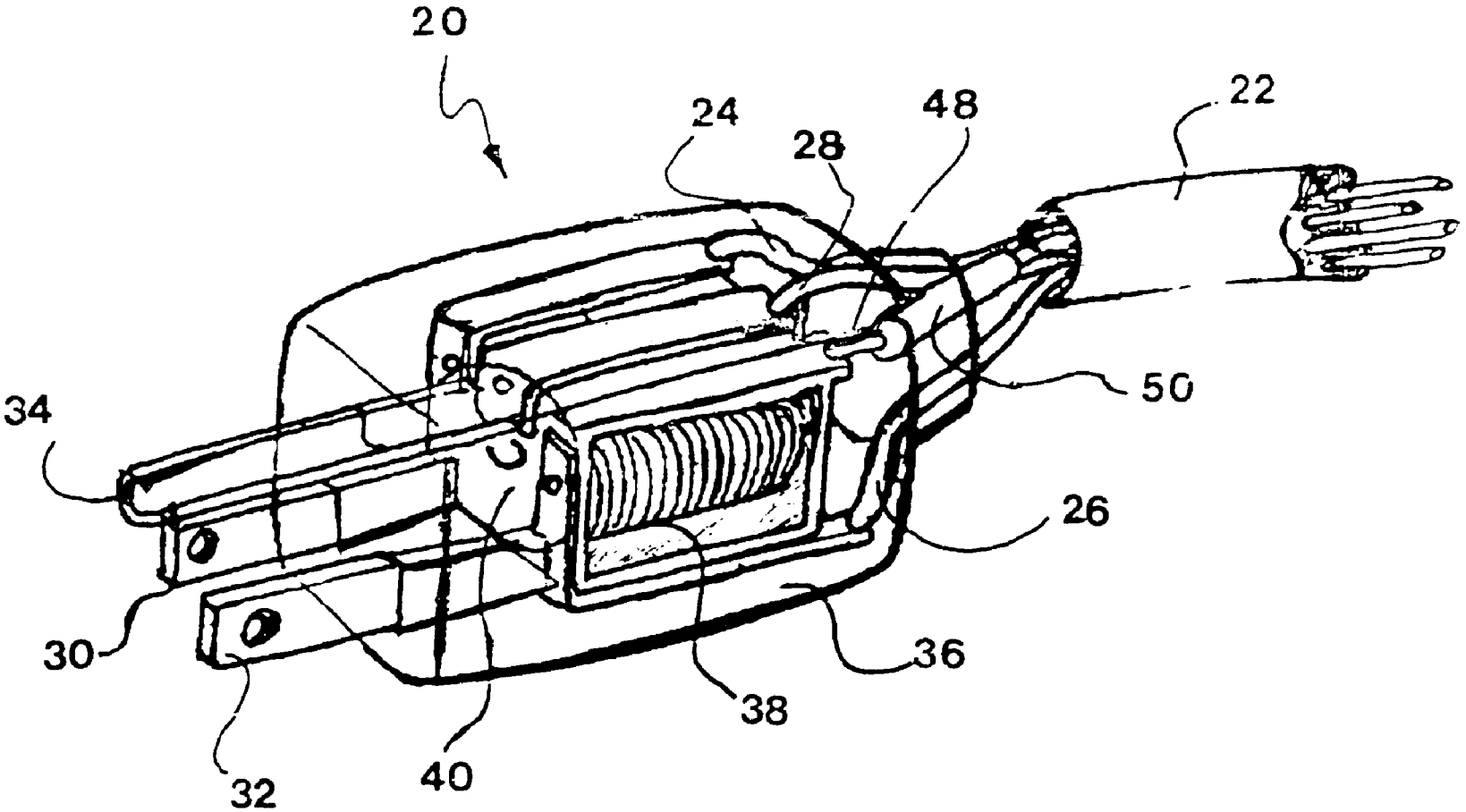
FIG. 1 is a cutaway perspective view of the one embodiment of an ejector plug according to this invention.
Figure 2:
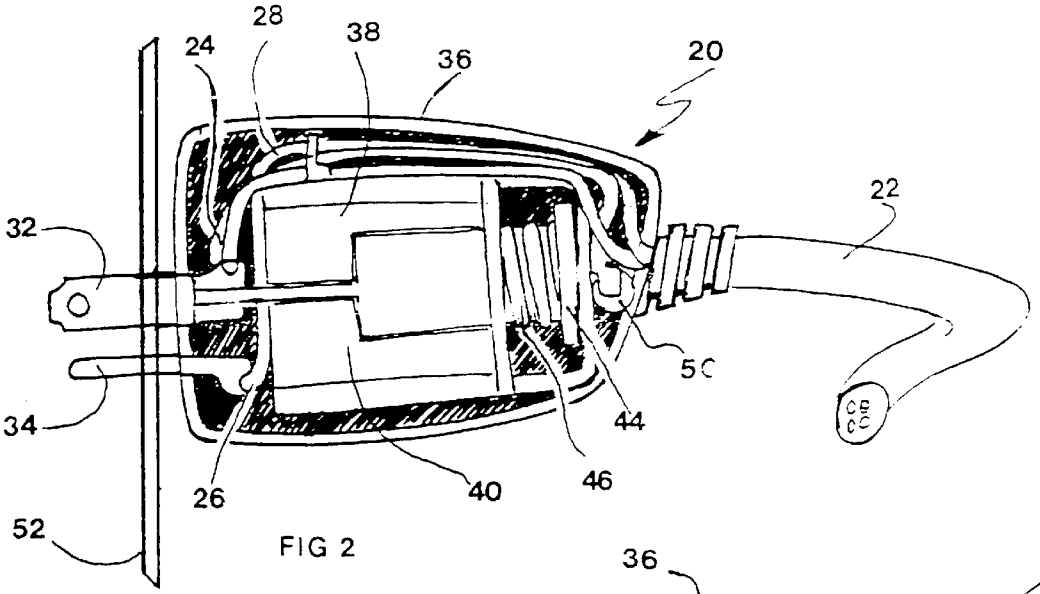
FIG. 2 is a side sectional view of the ejector plug illustrated in FIG. 1.
Figure 3:
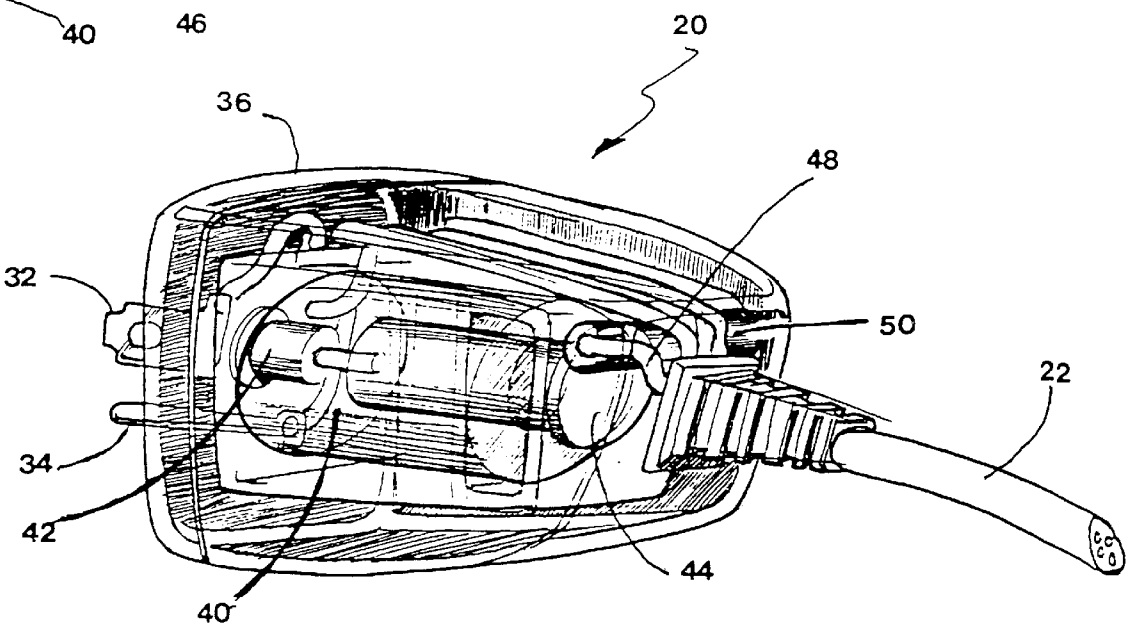
FIG. 3 is another cutaway perspective view of the ejector plug of FIG. 1.

FIGS. 1–3 show and in-line ejector plug 20 that is mounted on the end of a three conductor power cord 22 which is connected to an electrical appliance, such as a vacuum sweeper or floor polisher (not illustrated). Power cord 22 contains a hot wire 24, a neutral wire 26 and a ground wire 28. These wires connect to respective plug prongs 30, 32 and 34, respectively, which protrude from the end of a molded plug housing 36.

An electric motor in the form of solenoid 38 is contained within housing 36 and includes an armature 40, having an impact tip 42 at one end, that is extensible from housing 36. The other end of armature 40 has an enlarged head 44. A compression spring 46 is confined between the body of solenoid 38 and head 44 to bias the armature to retract within housing 36.

Power cord 22 also includes another hot wire 48 that connects through an in-line fuse 50 to solenoid 38. The other end of wire 48 is connected to an actuating switch (not illustrated) which, when actuated momentarily, energizes solenoid 38 to rapidly extend armature 40 and impact tip 42.

In use, plug 20 is plugged into a conventional electrical outlet by inserting prongs 30, 32 and 34 into openings in the face 52 of a wall socket to provide power to the appliance connected to the other end of power cord 22. After the appliance is used and it is desired to remove plug 20 and withdraw it to the proximity of the appliance for redeployment in another outlet or for storage on the appliance, the actuating switch is actuated. This will energize solenoid 38 which quickly extends armature 40 so that impact tip 42 strikes socket face 72 and forcibly withdraws plug prongs 30, 32 and 34 from the openings in socket face 52 to eject plug 20. Power cord 22 is now free to be pulled by the operator to the appliance.

Figure 4:
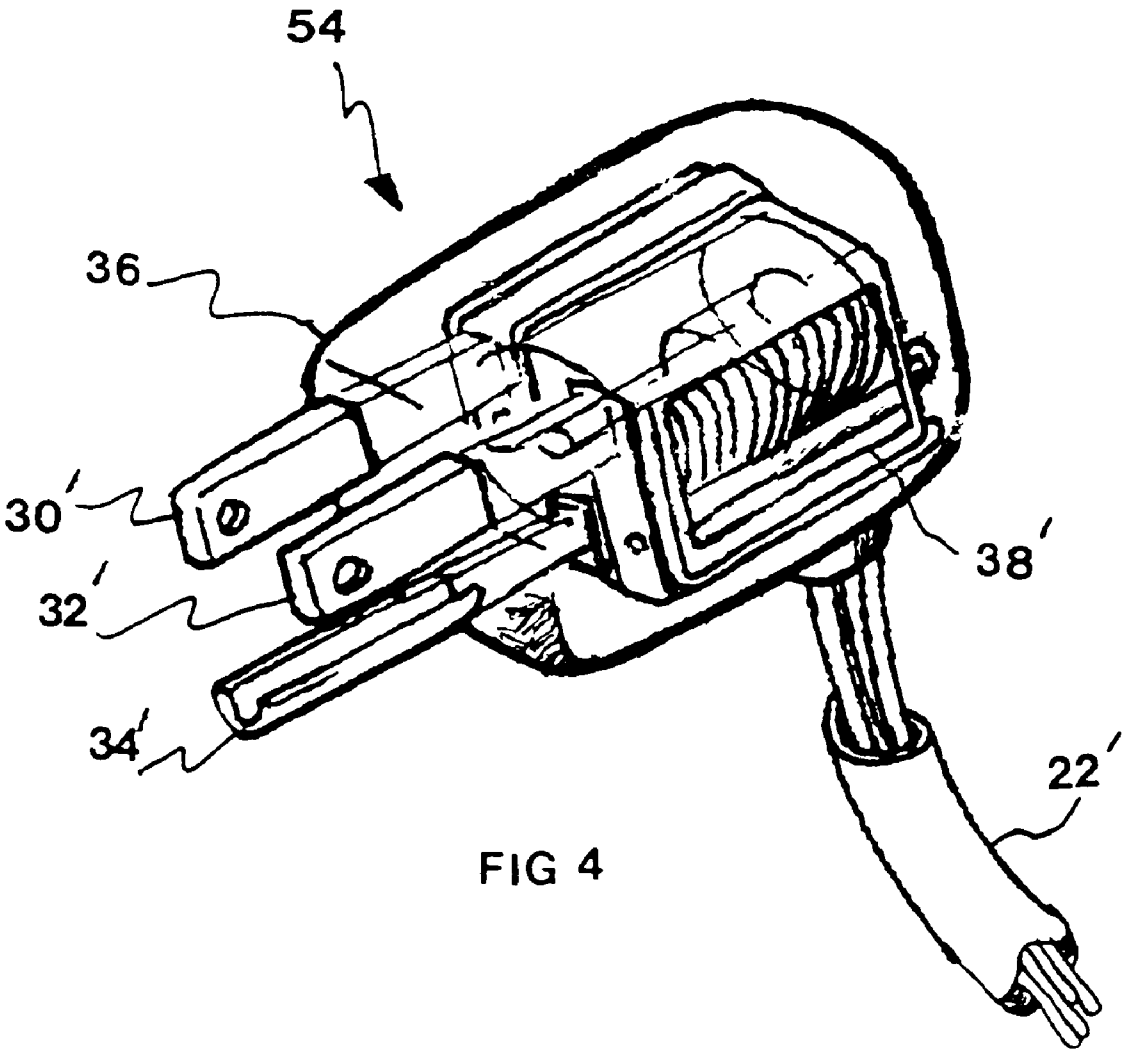
FIG. 4 is a cutaway perspective view of another embodiment of an ejector plug mounted on an extension cord.
Figure 6:
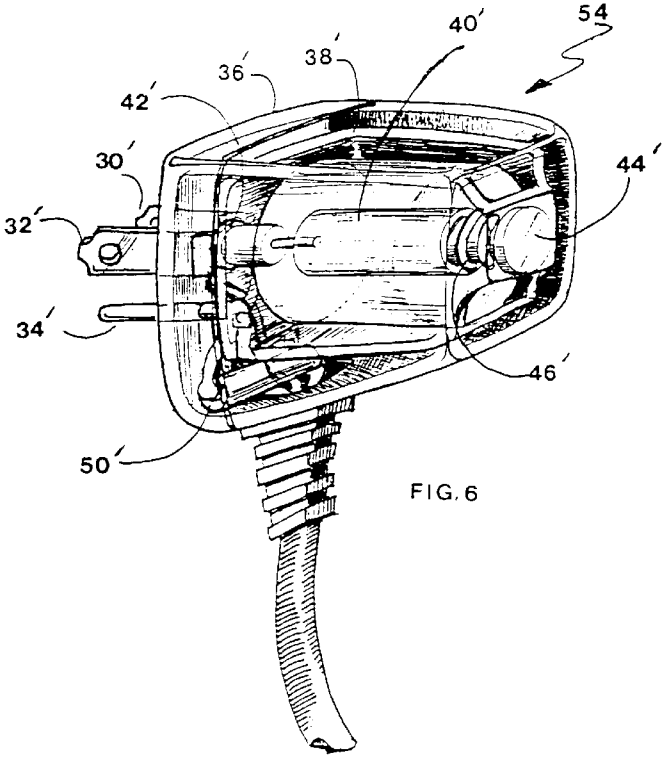
FIG. 6 is another cutaway perspective view of the ejector plug of FIG. 4.
Figure 5:
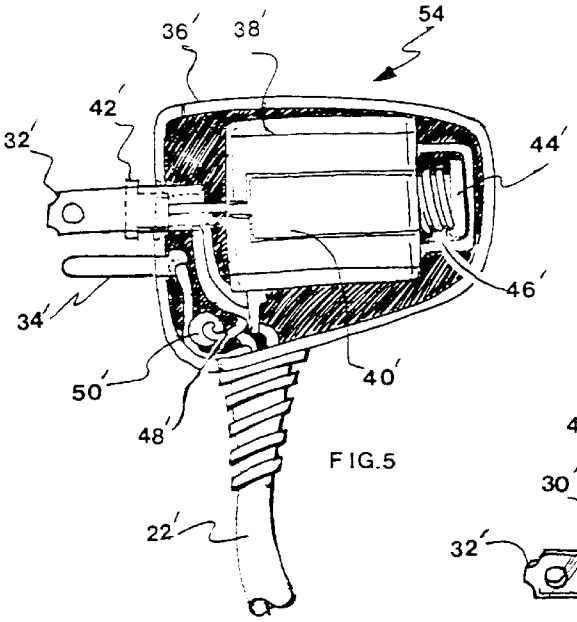
FIG. 5 is a side sectional view of the ejector plug illustrated in FIG. 4.

FIGS. 4, 5 and 6 illustrate a similar ejector plug 54 in which elements similar to those of plug 20 in FIGS. 1–3 are indicated by primed numbers. In this plug, power cord 22° is an extension cord oriented perpendicular to plug prongs 30', 32' and 34'. Extension cord 22' has a plug mounting an actuating switch 53 mounted on the other end. Operation of switch 53 operates solenoid 38'o extend armature 40' to eject the plug from a socket.

Figure 7A:
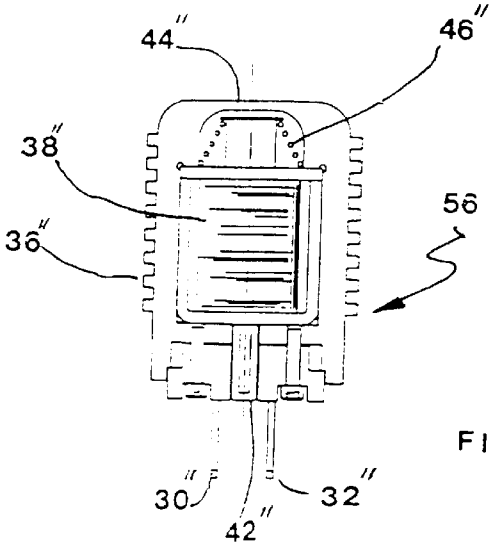
FIGS. 7*a* and 7*b* are side and top sectional views of another embodiment of ejector plug.
Figure 7C:
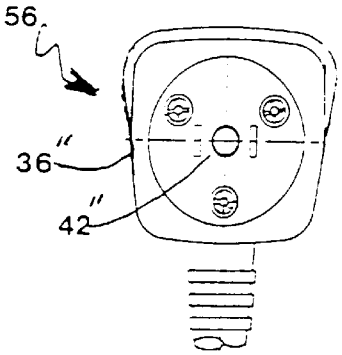
FIGS. 7*c* and 7*d* are front and other side elevational views of the ejector plug of FIGS. 7*a* and 7*b;*
Figure 7D:
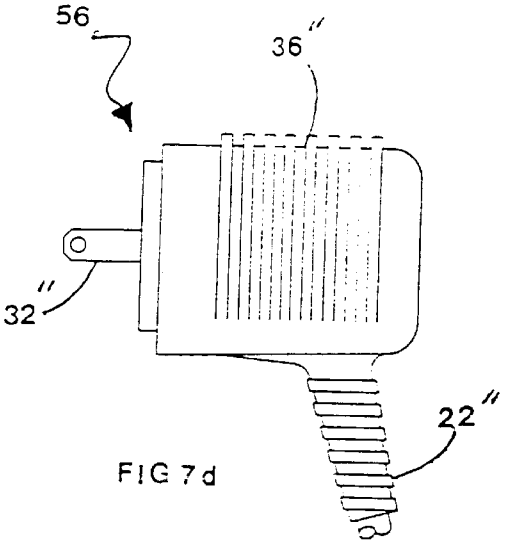
Figure 7B:
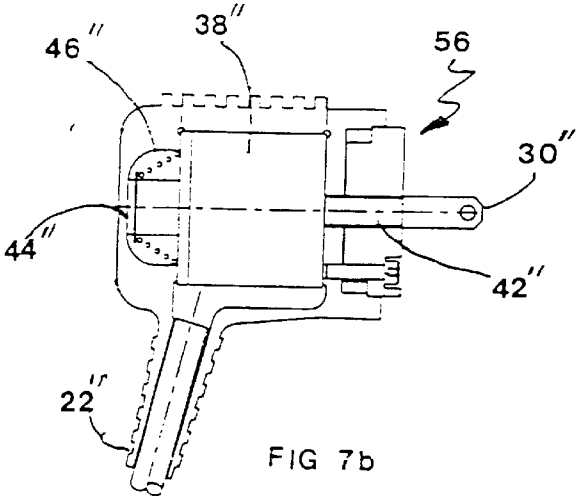

FIGS. 7*a,* 7*b,* 7*c* and 7*d* illustrate a two-prong perpendicular ejector plug 56 that is similar to plug 54, except that a ground prong is not included. Like elements are also indicated by like numbers double primed. This embodiment differs from those previously described by including three impact tips 42".

Figures 8, 9, 10:
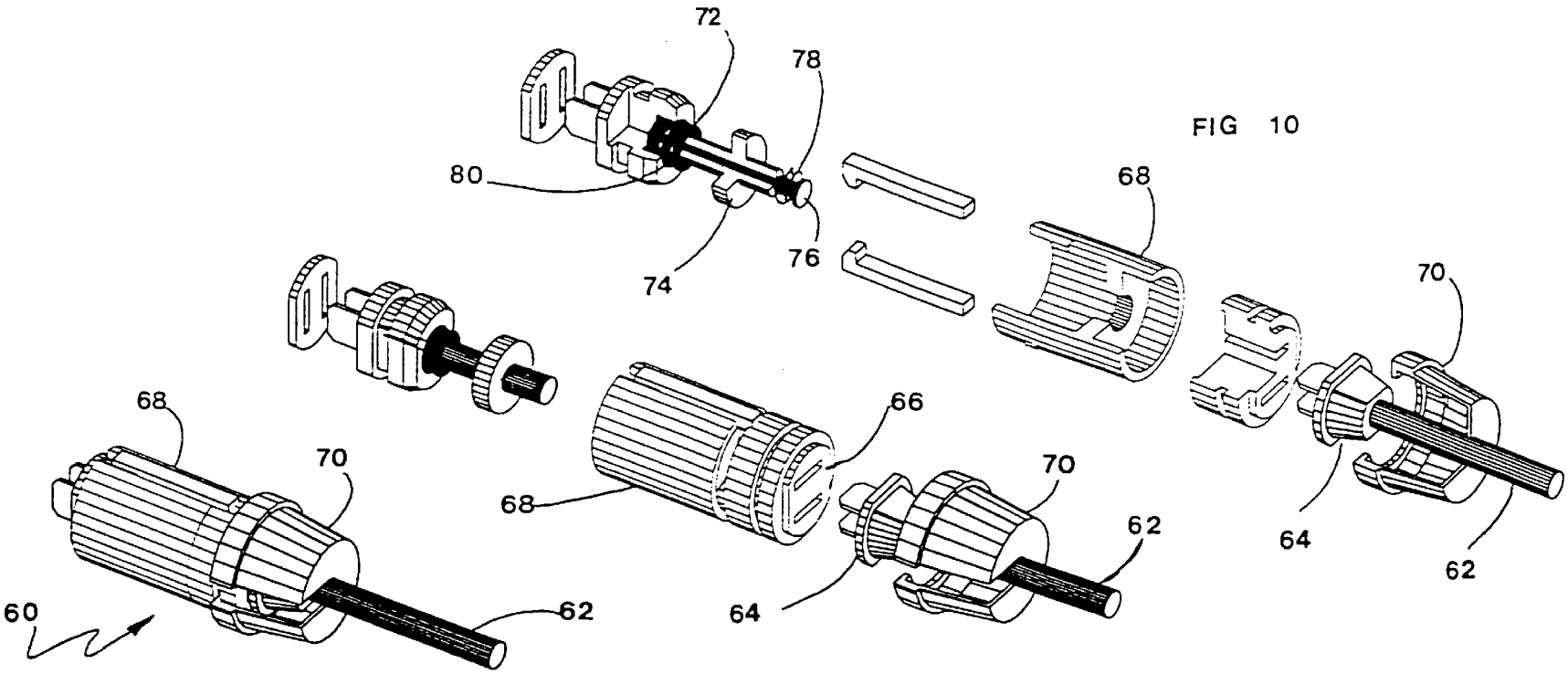
FIG. 8 is a perspective view of another embodiment of this invention.
FIG. 9 is an exploded perspective view of the ejector plug shown in FIG. 8.
FIG. 10 is a detailed, partially cutaway perspective view of the ejector plug of FIGS. 8 and 9.

The ejector plugs 20, 54 and 56 are all designed to be applied to appliances specially designed to incorporate the ejector plug. In contrast, FIGS. 8–10 illustrate yet a different embodiment of ejector plug in the form of an ejector plug unit 60, which is s self-contained unit designed for use with a conventional power cord 62 of an existing electrical appliance.

Here, the conventional appliance power cord plug 64 is plugged into the end 66 of housing 68 of ejector plug 60. an end cap 70 is snapped onto housing end 66 to retain plug 64. a solenoid 72 is contained within housing 68 and operates an armature 74 which has a head 76 and a retractor spring 78. In this embodiment, a control unit 80 is responsive to repeated fluctuations in line current (caused by repeated sequential operation of the appliance operating switch) to energize solenoid 72 and eject plug unit 60.

Figure 11:
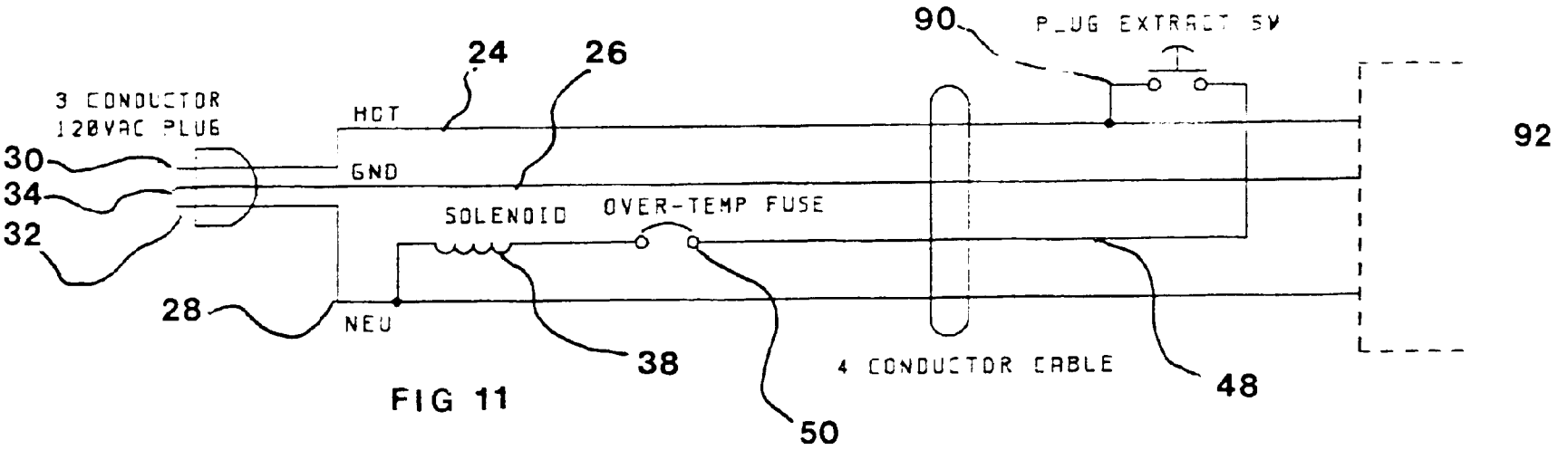
FIGS. 11 and 12 are schematic circuit diagrams for the embodiments shown in FIGS. 1 and 4, respectively.
Figure 12:
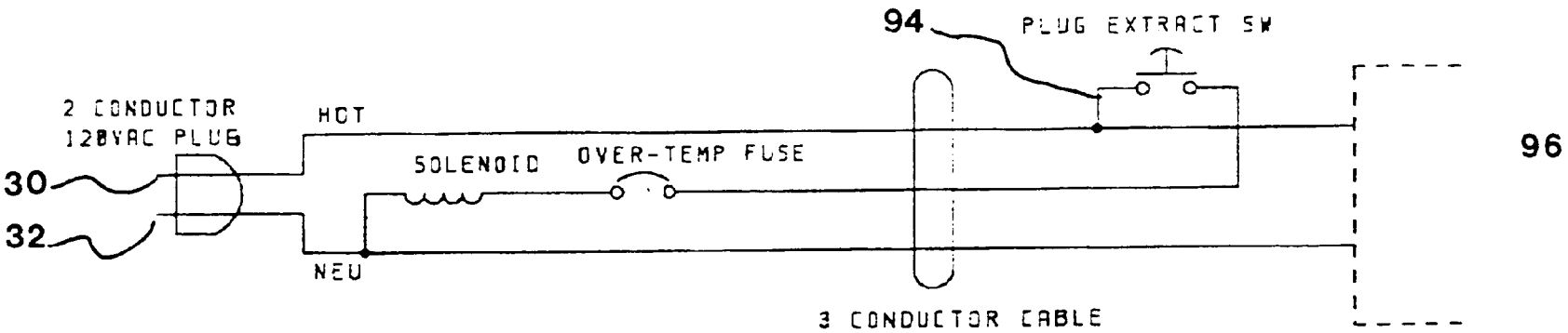

FIG. 11 is an electrical schematic for ejector plugs 20 and 54, and includes a remote actuating switch 90 mounted on a vacuum sweeper 92. FIG. 12 is an electrical schematic for plug 46 and includes remote actuating switch 94 mounted on a vacuum sweeper 96.

Figure 13B:
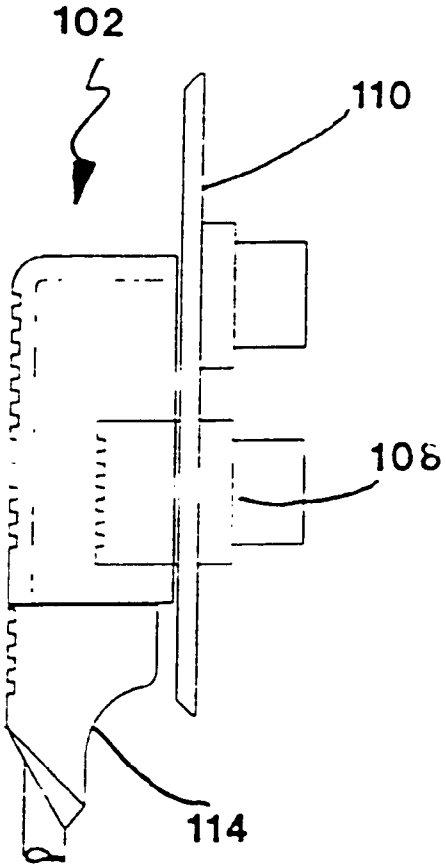
FIGS. 13*a* and 13*b* are plan and side views of the improved embodiment of plug ejector assembly according to this invention.
Figure 13A:
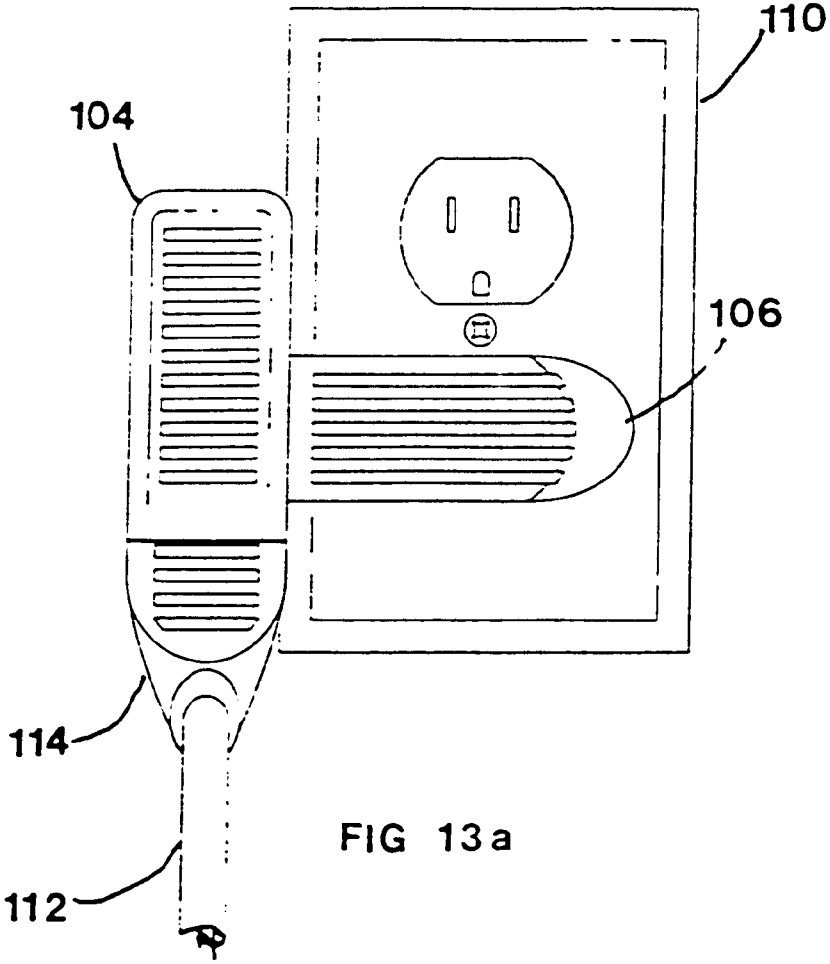

Referring to FIGS. 13*a,* 13*b,* 14*a* and 14*b,* a plug ejector assembly 102 comprises a plastic main ejector housing 104 located laterally of its integral adaptor plug 106 which Ohas 3 or 4 prongs 107 that conventionally plug into a wall socket 108 mounted in a socket cover plate 110. A special line cord 112 is connected at its distal end to an electrical appliance (not illustrated) an includes a special plug 114 having 3 or 4 prongs 116 plugged into, and ejectable from an adaptor socket 118.

Upon activation of a switch (not shown) by a user of the appliance, solenoid 120 will extend and forcibly eject adaptor plug 114, cutting power to the appliance.

Figures 14A, 14B:
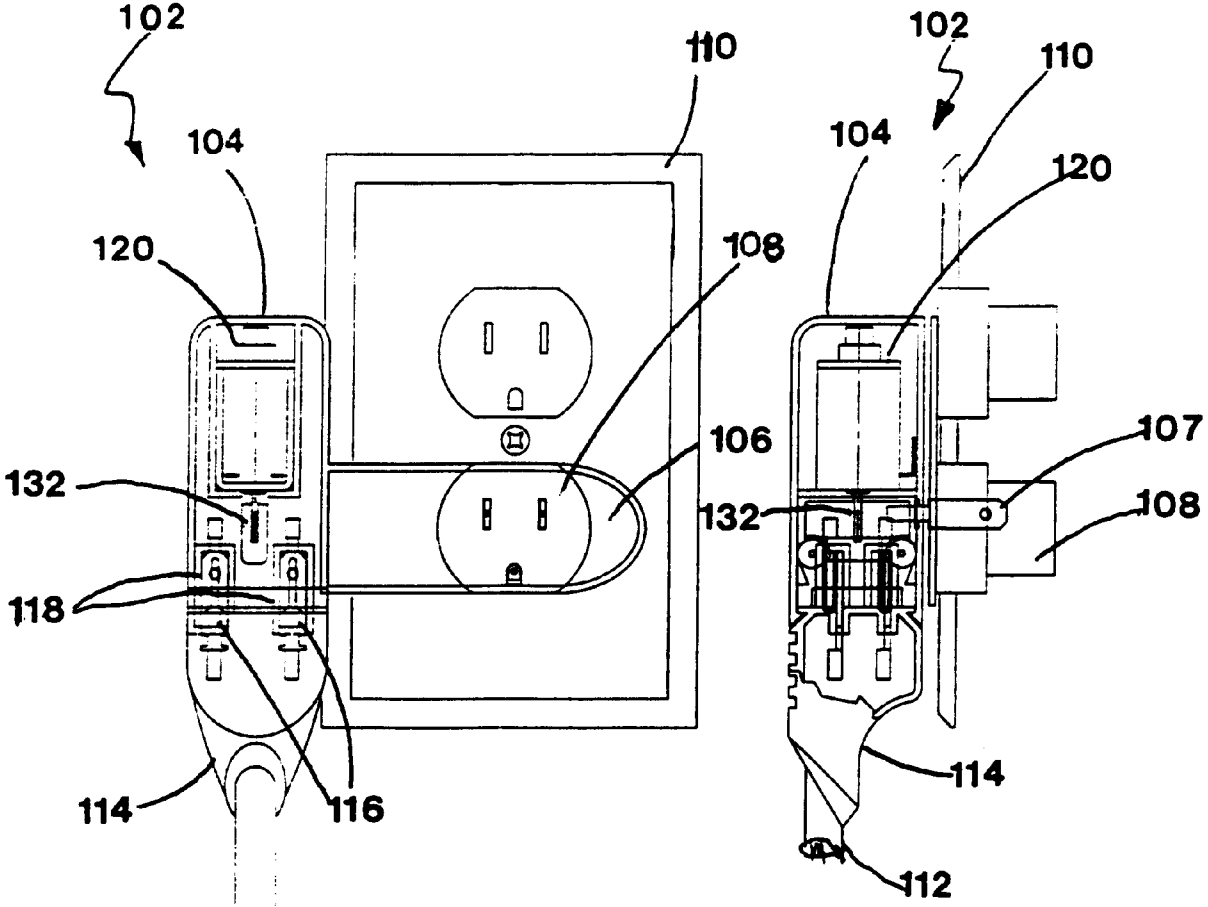
FIGS. 14*a* and 14*b* are cutaway views of FIGS. 13*a* and 13*b;*
Figure 15B:
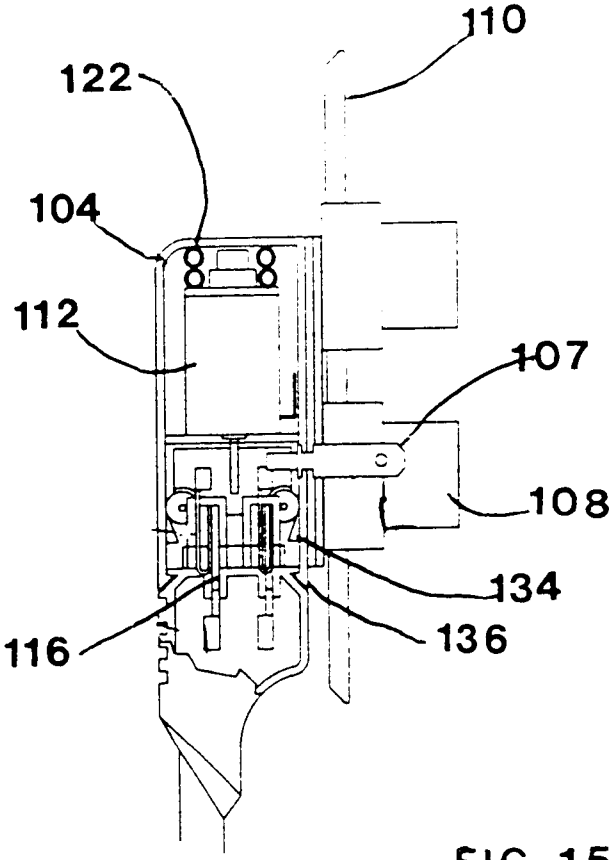
FIGS. 15*a* and 15*b* are partial cutaway views of FIG. 14*b,* showing different degrees of detail.
Figure 15A:
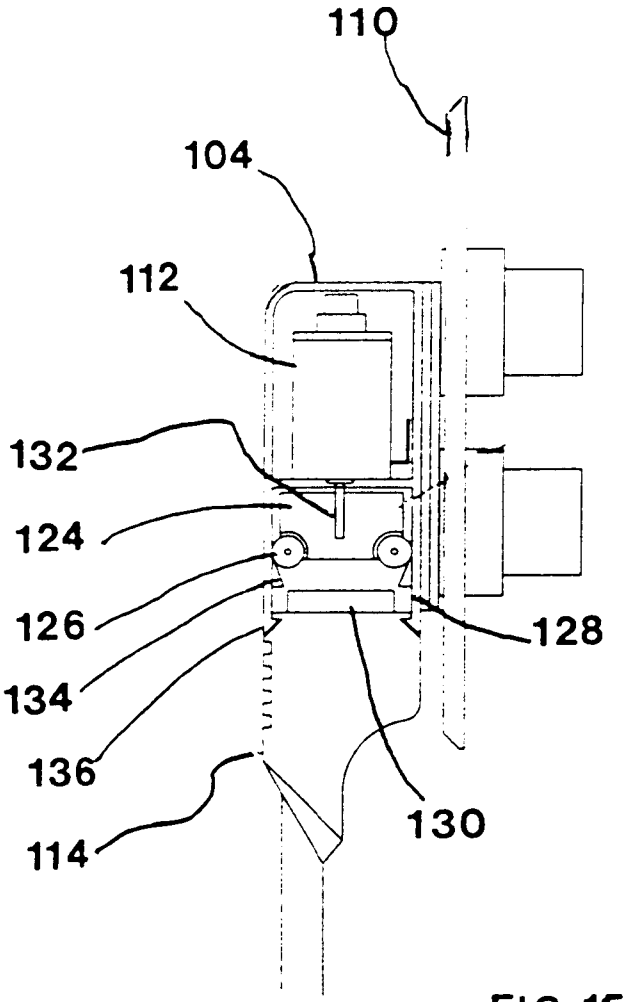

As shown in FIGS. 14*a,* 14*b,* 15*a* and 15*b,* housing 104 contains a solenoid 120 and an optional return spring 122. A push block 124 is mounted for movement on rollers 126 that roll on the interior of housing 104. A snap action latch 128 is integral with the bottom roller retainer portion 130 of push block to retain solenoid 120 in its retracted position.

Upon activation, solenoid plunger 132 and push block 124 extend to engage and forcibly eject adaptor plug 114. Upon extension, rollers 126 engage latch ramps 126 to force retention latch tangs 136. Note that adaptor assembly 102 remains plugged into wall socket 108. Thus, with this embodiment, a separate ejector assembly 102 must be provided for each wall socket. However, the worker time save from having to walk 50 or 100 ft. to unplug the appliance plug, and then back again, saves productivity time that will quickly recoup the cost od the adaptor plug assemblies. Also, since the frictional force between the adaptor plug prongs and the adaptor socket can be controlled and minimized, the cost of components can be minimized.

Figure 16:
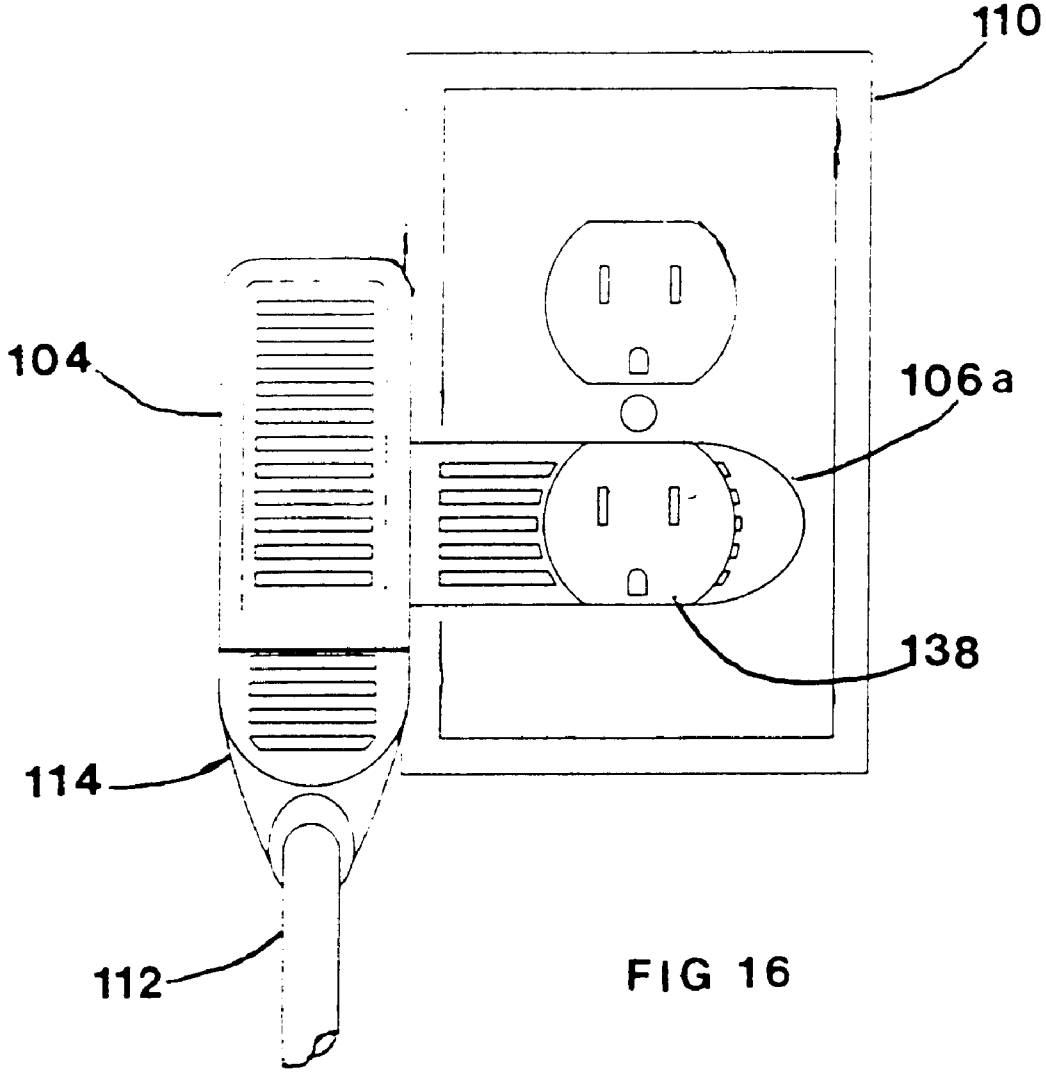
FIG. 16 a plan view of another improved embodiment.

While the FIGS. 13*a,* 13*b,* 14*a,* and 14*b* embodiment requires dedication of one of the wall sockets. However, FIG. 16 shows a modified embodiment which adds a plug through socket 106*a* which can accommodate any plug from any other electrical appliance, thus allowing full use of the socket.

Figure 17:
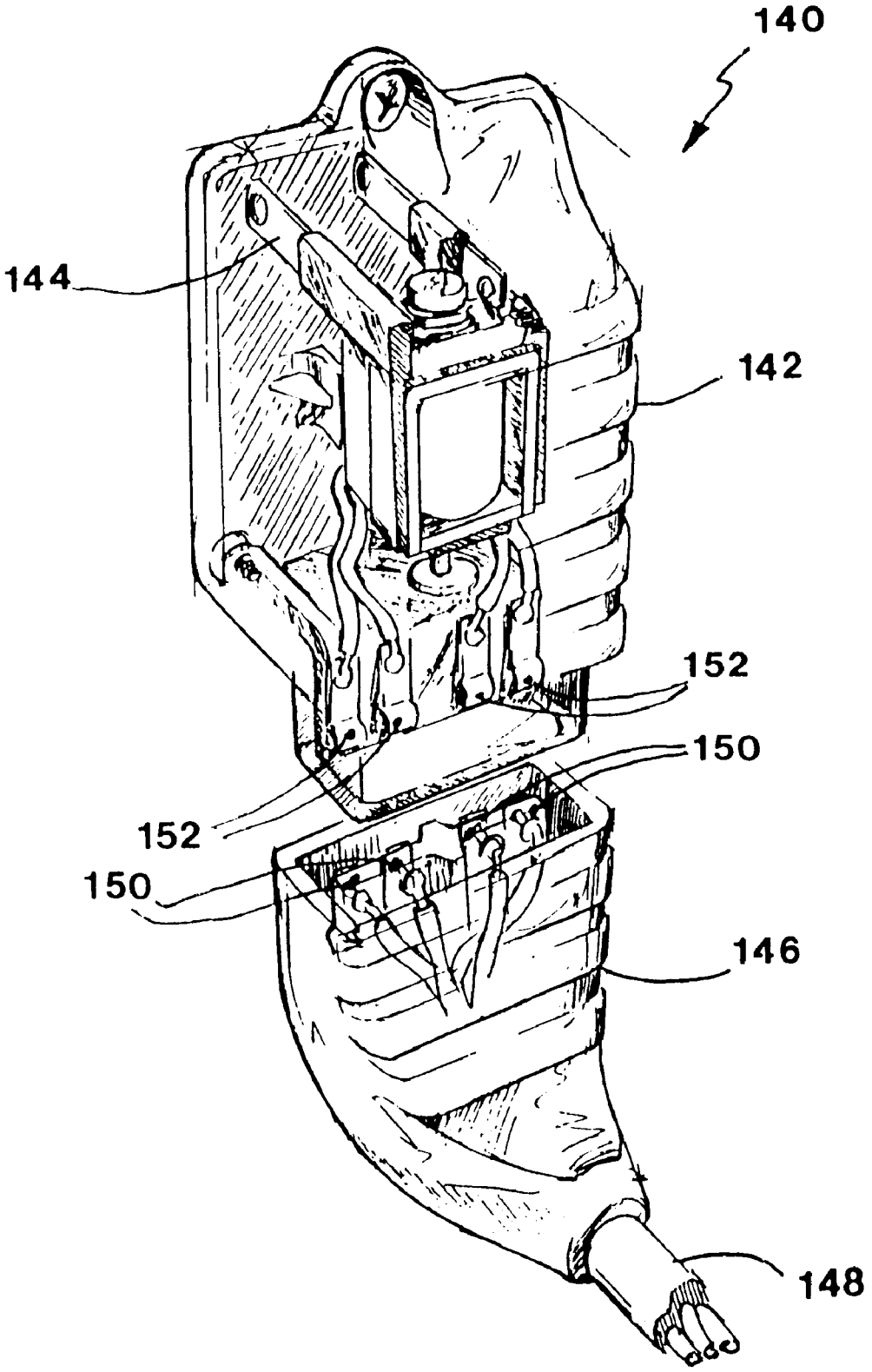
FIG. 17 is a perspective cutaway view of yet another improved embodiment.

FIG. 17 shows another embodiment which comprises a vertically-oriented ejector plug assembly 140 includes an ejector housing 142 that includes conventional prongs 144 which plug into a wall socket. An adaptor plug 146 is mounted on the end of line cord 148. Plug 146 contains 4 blade contacts 150 which slidingly mate with adaptor spring contacts 152. Operation is generally as above, except that frictional force exerted on contacts 150 is reduced.

Figure 18B:
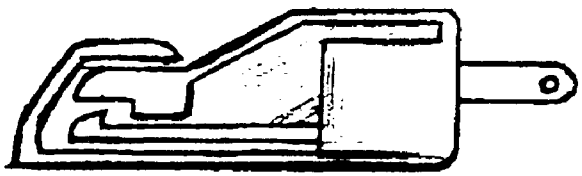
FIGS. 18*a* and 18*b* are perspective and side cutaway views of a still further improved embodiment.
Figure 18A:
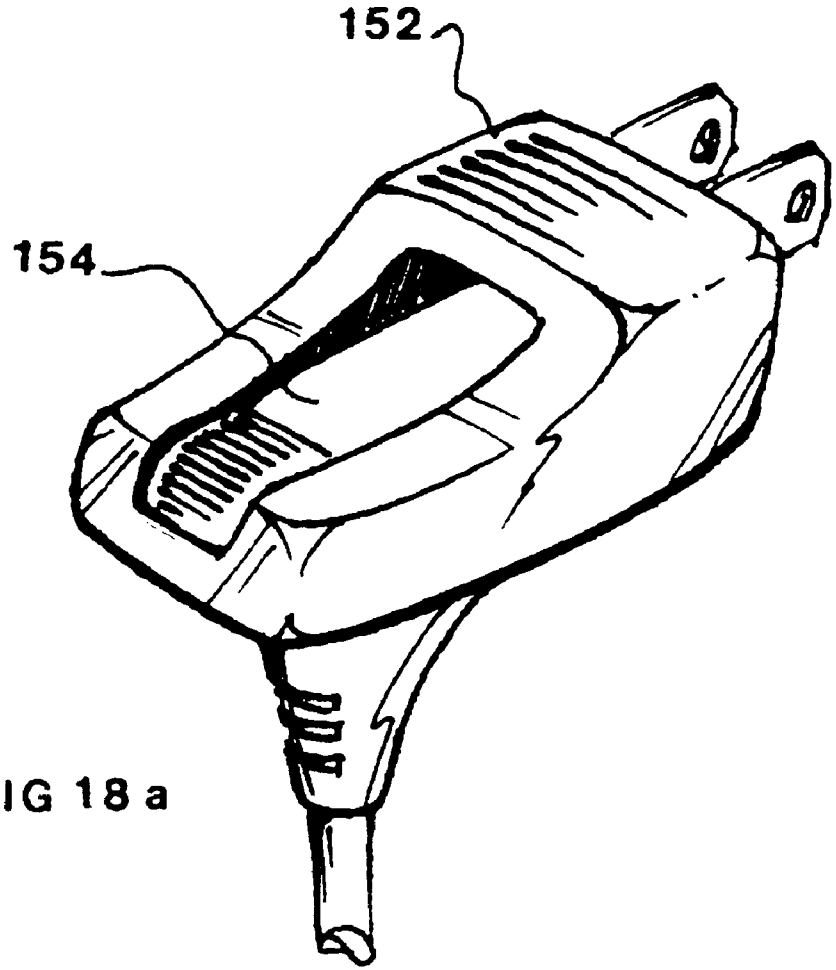
Figure 19:
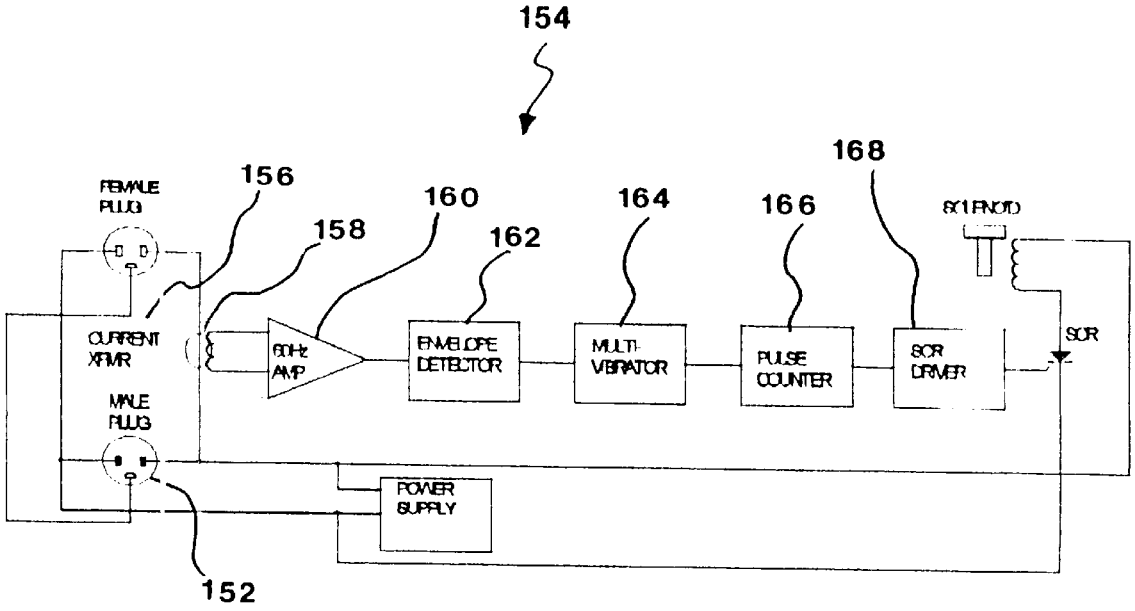
FIG. 19 is a schematic wiring diagram of the FIG. 18*a* and 18*b* embodiment.

FIGS. 18*a* and 18*b* show another embodiment of plug 152 which includes a power pulse-sensing solenoid driver 154 which functions to sense multiple power surges to actuate the solenoid. The circuit for operating this embodiment is schematically shown in FIG. 19. To operate, the appliance switch is rapidly cycled to eject the plug. This eliminates the need for a separate operating line and switch.

When the switch remote (not shown) is rapidly cycled, the SCR driver energizes the solenoid. At the plug 152, one of the wires carrying current passes through a current transformer 156. A voltage pulse that is proportional to current appears on the winding 158 and is amplified by amplifier 160. The envelope configuration at 162 is detected and converted to a fixed width pulse by a multi-vibrator 164. The pulse occurs only when current is interrupted. A pulse counter 166 accumulates the pulses that occur during a predetermined time period. If the number exceeds an established threshold, pulse counter 166 sends a signal to an SCR driver 168 to turn on, causing current to flow in the solenoid for a fixed time period to eject plug 152 from the wall socket.

Figure 20:
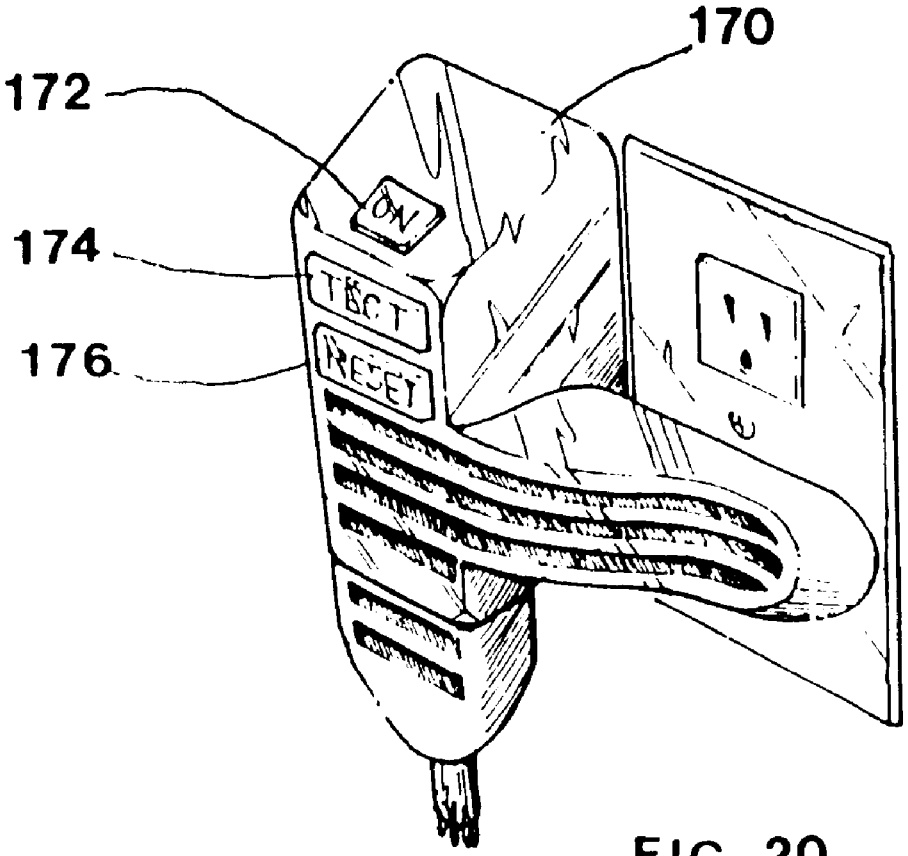
FIG. 20 is a perspective sketch of another embodiment of plug ejector incorporating a GFI device.

In FIG. 20, another embodiment of plug ejector 170 incorporates a conventional ground fault interruption (GFI) device having "on" 172, "test" 174 and "reset" 176 buttons. This embodiment is particularly useful in construction jobs outside, which requires operation in all types of weather.

While only preferred embodiments have been illustrated and described, obvious modifications thereof are contemplated within the scope of this invention. For instance, the sensor could sense vibration levels exceeding a predetermined level, or by a tilt from the horizontal exceeding a predetermined angle (evidencing building damage caused by a natural or other catastrophe) to eject the ejector plug to minimize any electrical fires.

We claim:

1. A plug elector assembly for disconnecting the prongs of an electrical plug from the electrical supply of an electrical supply socket, comprising an adapter for insertion into the electrical supply socket and having an adapter socket, a housing an elector member mounted in the housing for sliding movement between a retracted position and an extended position, and an electric solenoid for moving the ejector member from the retracted to the extended position, whereby when the plug prongs are inserted into the adapter socket, subsequent energization of the electric solenoid extends the ejector member to impact the socket and eject the prongs from the adapter socket, wherein the adapter incorporates a vibration-sensing or tilt-sensing actuator for causing ejection of the plug from the socket to disconnect electrical supply to electrical appliances during earthquakes or other building-damaging events to reduce the possibility of appliance caused fire.

2. A plug ejector for ejecting an electrical plug, which is mounted on the distal end of a power supply cord for an electrical appliance having an on-off switch, from an electric socket, comprising a plug housing having prongs insertable into said socket, an ejector member mounted in the housing for sliding movement between a retracted position and an extended position, and an electric solenoid for moving the ejector member from the retracted to the extended position, whereby rapid repeated action of the on-off switch energizes the electric solenoid to extend the ejector member to impact the socket and eject the prongs from the socket.

3. A plug ejector assembly for disconnecting the prongs of an electrical plug from the electrical supply of an electrical supply socket, comprising an adapter for insertion into the electrical supply socket and having an adapter socket, a housing, an ejector member mounted in the housing for sliding movement between a retracted position and an extended position, and an electric solenoid for moving the ejector member from the retracted to the extended position, whereby when the plug prongs are inserted into the adapter socket, subsequent energization of the electric solenoid extends the sector member to impact the socket and eject the prongs from the adapter socket, wherein the plug is mounted on an end of an elongated power cord connected to an electric appliance, which has an on-off switch which operates as an actuating switch to actuate said electric solenoid upon repeated operation of said switch.

4. The plug ejector of claim 3, wherein the adapter incorporates an electrical overload protector.

* * * * *